US010875154B2

(12) United States Patent
Dow

(10) Patent No.: US 10,875,154 B2
(45) Date of Patent: Dec. 29, 2020

(54) DRYWALL SANDING BLOCK AND METHOD OF USING

(71) Applicant: 3M INNOVATIVE PROPERTIES COMPANY, St. Paul, MN (US)

(72) Inventor: David R. Dow, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 295 days.

(21) Appl. No.: 15/764,522

(22) PCT Filed: Sep. 30, 2016

(86) PCT No.: PCT/US2016/054740
§ 371 (c)(1),
(2) Date: Mar. 29, 2018

(87) PCT Pub. No.: WO2017/059229
PCT Pub. Date: Apr. 6, 2017

(65) Prior Publication Data

US 2018/0281155 A1 Oct. 4, 2018

Related U.S. Application Data

(60) Provisional application No. 62/236,670, filed on Oct. 2, 2015.

(51) Int. Cl.
*B24D 15/04* (2006.01)
*B24D 15/02* (2006.01)

(52) U.S. Cl.
CPC ..... *B24D 15/04* (2013.01); *B24D 15/023* (2013.01)

(58) Field of Classification Search
CPC ..... B24D 15/04; B24D 15/023
See application file for complete search history.

(56) References Cited

U.S. PATENT DOCUMENTS

| | | | |
|---|---|---|---|
| 2,772,471 | A | 12/1956 | Leng |
| 3,041,156 | A | 6/1962 | Rowse |
| 4,111,666 | A | 9/1978 | Kalbow |
| 4,255,164 | A | 3/1981 | Butzke |
| 4,314,827 | A | 2/1982 | Leitheiser |
| 4,391,013 | A | 7/1983 | Janssen |
| 4,623,364 | A | 11/1986 | Cottringer |

(Continued)

FOREIGN PATENT DOCUMENTS

| | | |
|---|---|---|
| CN | 202225099 | 5/2012 |
| DE | 20112283 | 9/2001 |

(Continued)

OTHER PUBLICATIONS

International Search Report for PCT International Application No. PCT/US2016/054740, dated Dec. 11, 2016, 5pgs.

*Primary Examiner* — Dung Van Nguyen
(74) *Attorney, Agent, or Firm* — Kevin Weber

(57) ABSTRACT

A sanding block adapted for abrading a surface, particularly drywall joints, comprising: (a) a body having an array of elongated raised portions having raised end surfaces and recessed portions, the raised end surfaces collectively defining an abrasive working surface and the recessed portions defining channels between adjacent raised portions; (b) a make coat on the end surfaces; and (c) abrasive particles at least partially embedded in the make coat. Also methods of using such sanding blocks.

20 Claims, 4 Drawing Sheets

(56) References Cited

U.S. PATENT DOCUMENTS

| | | | | |
|---|---|---|---|---|
| 4,652,274 | A | 3/1987 | Boettcher | |
| 4,652,275 | A | 3/1987 | Bloecher | |
| 4,714,644 | A * | 12/1987 | Rich | B24D 15/04 428/136 |
| 4,735,632 | A | 4/1988 | Oxman | |
| 4,744,802 | A | 5/1988 | Schwabel | |
| 4,751,138 | A | 6/1988 | Tumey | |
| 4,770,671 | A | 9/1988 | Monroe | |
| 4,881,951 | A | 11/1989 | Wood | |
| 4,903,440 | A | 2/1990 | Larson | |
| 4,950,696 | A | 8/1990 | Palazotto | |
| 4,985,340 | A | 1/1991 | Palazzotto | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,085,671 | A | 2/1992 | Martin | |
| 5,213,951 | A | 5/1993 | Delfino | |
| 5,236,472 | A | 8/1993 | Kirk | |
| 5,256,170 | A | 10/1993 | Harmer | |
| 5,378,252 | A | 1/1995 | Follensbee | |
| 5,674,122 | A | 10/1997 | Krech | |
| 5,975,988 | A | 11/1999 | Christianson | |
| 6,227,959 | B1 | 5/2001 | Beaudry | |
| D447,297 | S * | 8/2001 | Denney | D32/40 |
| D447,299 | S * | 8/2001 | Denney | D32/40 |
| 6,524,175 | B2 | 2/2003 | Beaudry | |
| 7,169,029 | B2 * | 1/2007 | Petersen | B24D 11/005 451/523 |
| 7,252,582 | B2 | 8/2007 | Renteln | |
| 7,270,595 | B2 | 9/2007 | Elmufdi | |
| 7,294,048 | B2 | 11/2007 | Nelson | |
| 7,364,500 | B2 | 4/2008 | Brown | |
| D578,718 | S | 10/2008 | Bettanin | |
| 7,497,768 | B2 | 3/2009 | Minick | |
| 8,628,381 | B2 | 1/2014 | Arvinte | |
| 8,871,331 | B2 * | 10/2014 | Seth | B24B 37/245 428/195.1 |
| 2007/0243804 | A1 | 10/2007 | Peterson | |
| 2012/0000135 | A1 | 1/2012 | Eilers | |
| 2014/0308884 | A1 | 10/2014 | Janssen | |
| 2015/0251289 | A1 | 9/2015 | Creighton | |

FOREIGN PATENT DOCUMENTS

| | | |
|---|---|---|
| EP | 1207015 | 5/2002 |
| FR | 743143 | 3/1933 |
| WO | WO 2006-065411 | 6/2006 |

* cited by examiner

DRYWALL SANDING BLOCK AND METHOD OF USING

CROSS REFERENCE TO RELATED APPLICATIONS

This application is a national stage filing under 35 U.S.C. 371 of PCT/US2016/054740, filed Sep. 30, 2016, which claims the benefit of provisional Application No. 62/236,670, filed Oct. 2, 2015, the disclosure of which is incorporated by reference in its/their entirety herein.

FIELD

This invention relates to a sanding block and method of use, particularly suitable for use with drywall.

BACKGROUND

One common form of construction of interior walls and ceilings uses drywall. Drywall (also known as plasterboard, wallboard, sheetrock, gypsum panel, or gypsum board) is a panel made of calcium sulfate dihydrate (gypsum), optionally with or without additives, that typically comprises paper facer and backer. The joints between two adjacent wallboards are commonly "taped" and "mudded" with joint compound, then sanded and smoothed so that they are not noticeable. Similarly, holes in drywall panels may be filled (e.g., holes caused by damage to a surface such as punctures or removal of electrical components, etc.).

The taping of wallboard joints has in the past been a relatively complicated, time consuming, messy, and often frustrating procedure. The traditional method of smoothing taped joints involves the applying one or more, often at least three coats of wallboard joint compound, which is commercially available as a ready-mixed paste and a powder form (i.e., which is mixed with water to form a paste).

In a typical three coat approach, the first step of taping a wallboard joint involves applying a thick layer of joint compound which completely fills the seam formed by the abutting wallboard sheets. Then, wallboard tape is embedded into the thick layer of joint compound. The wallboard tape is a perforated tape (e.g., fiberglass), commonly having a width of about two inches, and sold in rolls. The tape is typically substantially centered over the length of the seam and is pressed into the thick first layer of joint compound so that the compound oozes through the perforations of the tape. A wallboard knife is usually used to press the tape into the first layer of joint compound. After the first layer of joint compound (with embedded tape) has dried, it is usually sanded (e.g., with dry sandpaper wrapped around a sanding block) to remove dried joint compound, etc. to smooth the joint or patch. This sanding step is particularly necessary if the surface of the first layer of joint compound is rough. A second thin layer of joint compound is then applied over the first layer of joint compound and the wallboard tape. This second layer joint compound is typically wider (generally about 15 to about 20 centimeters (6 to 8 inches) wider) than the first layer. After the second layer has dried, sanding of the second layer is once again performed to smooth the joint. A third thin layer of joint compound is then applied over the second layer. This third layer is feathered out to about 30 to about 36 centimeters (12 to 14 inches) from the center of the joint. When the third coat of joint compound is thoroughly dry, it is sanded with a dry medium sandpaper. Once the surface of the wallboard joint is smooth and even, a primer coat is applied.

Smoothing wallboard tape joints can often be the messiest step in building an interior room. The residual dust that is formed by sanding makes a mess tends to disperse widely and is difficult to clean up. The dust from sanding often becomes airborne, which spreads the dust further, and makes working in the room unpleasant. In addition, if water drips on the dust (e.g., from sweat, spills, etc.) it tends to form cement deposits which may require scraping or vigorous brushing action to remove.

There is a continuing need for improved tools for smoothing wallboard joints as well as improved methods of smoothing wallboard joints.

SUMMARY

The present invention provides new sanding blocks with novel features that are particularly suited for use in sanding drywall joints. The sanding blocks described herein provide surprisingly improved reduction in free dust which in turn results in cleaner project environments and reduced costs. The present invention also provides a method of using sanding blocks as described herein.

In brief summary, a sanding block of the invention typically comprises:

(a) a body having an array of a plurality of elongated raised portions having raised end surfaces and a plurality of recessed portions, the raised end surfaces collectively defining an abrasive working surface and the recessed portions defining channels between adjacent raised portions;

(b) a make coat on at least a portion of the end surfaces; and (c) abrasive particles at least partially embedded in the make coat;

wherein the recessed portions have an average depth of at least about 2 mm and have an average narrow dimension of at least about 2 mm, and the channels have an average longest straight line dimension of from about 15 to about 50 mm; and wherein the raised portions have a minimum straight line dimension of at least about 15 mm.

Briefly summarizing, the method of the invention comprises:

(a) providing a sanding block as described herein;

(b) grasping the sanding block by hand such that the working surface is presented to engage with a drywall joint or patch;

(c) contacting the working surface to the drywall joint or patch; and (d) repeatedly moving the sanding block in an abrasive manner against the drywall joint or patch so as to smooth the drywall joint or patch.

The invention enables easy, effective sanding of drywall joints with surprising reduction in dust generation and easier clean up than is encountered with conventional drywall sanding materials and methods.

BRIEF DESCRIPTION OF DRAWING

The invention is further explained with reference to the drawing wherein.

These figures are not to scale and are intended to be merely illustrative and not limiting. Like reference numbers are used to refer to like elements.

DETAILED DESCRIPTION OF ILLUSTRATIVE EMBODIMENTS

Unless otherwise indicated, all numbers expressing quantities of ingredients, properties such as molecular weight, reaction conditions, and so forth used in the specification and claims are to be understood as being modified in all instances by the term "about". Accordingly, unless indicated to the contrary, the numerical parameters set forth in the foregoing specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviations found in their respective testing measurements.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g., 1 to 5 includes 1, 1.5, 2, 2.75, 3, 3.80, 4, and 5). As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Figure 1:
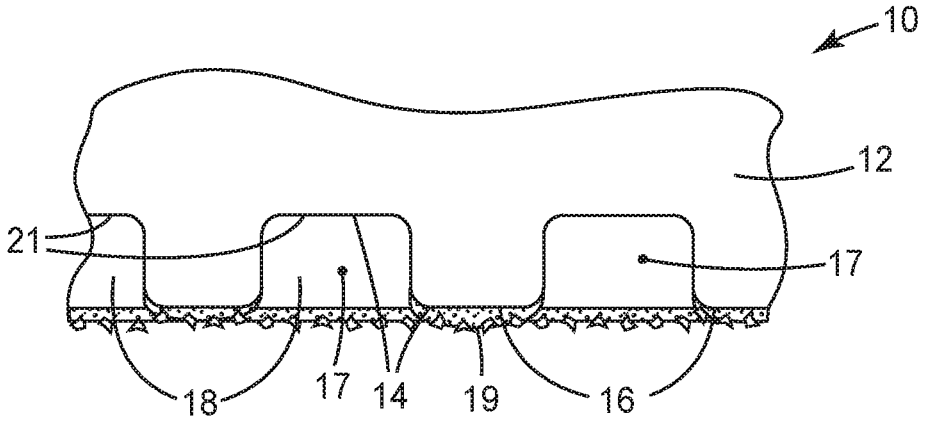
FIG. 1 is a perspective view of a portion of the end of the sanding block shown in FIG. 3.
Figure 2:
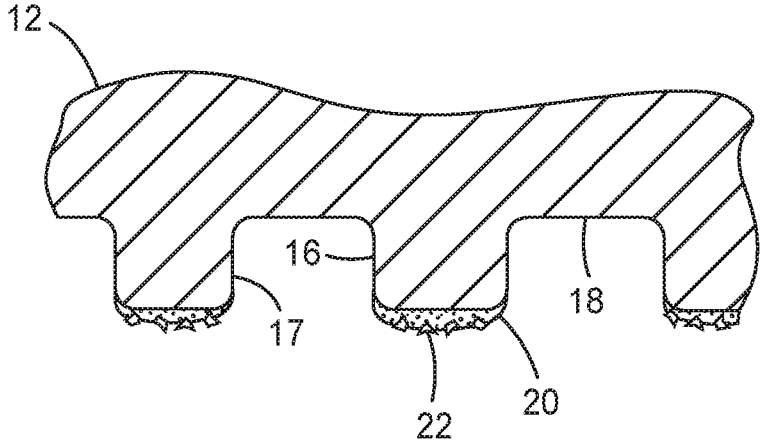
FIG. 2 is a cross section view of a portion of the sanding block shown in FIG. 3.

As shown in FIGS. 1 and 2, sanding block 10 of the invention typically comprises body 12 having working surface 14 adapted for abrading a surface (not shown) such as a drywall joint or patch which has been taped and mudded. The working surface is made up an array of one or more raised portions 16 defining channels 18 and having abrasive coating 19 thereon. Channels 18 have side walls 17 and bottom walls 21. The raised portions are at least partially coated with a make coat 20 (sometimes referred to as a make coat adhesive) with a plurality of abrasive particles 22 at least partially embedded in the make coat. Side walls 17 and bottom walls 21 may have substantially straight profiles as shown, but need not be. In many instances, manufacturing the body will be facilitated if the channels are somewhat wider at the open end than at the bottom wall side (e.g., to facilitate release from a molding tool). Making the open end of the channels significantly wider than the top of the raised portions tends to reduce the abrasive effectiveness of the tool (by reducing the proportion of the tool face which imparts abrasive action) whereas making the channels relatively smaller tends to reduce the desired reduction in dust dissemination which is the object of the invention.

The invention may be better understood with reference to a three dimensional context defined by three mutually perpendicular axes, that is x-axis, y-axis, and z-axis, wherein the x-axis and y-axis correspond to the general plane of the working surface and the z-axis corresponds to the depth of the channels. As used herein, in FIG. 1, the x-axis extends horizontally across the figure as shown, the y-axis extends perpendicularly into the plane of the image as shown, and the z-axis extends vertically across the figure as shown.

Figure 3:
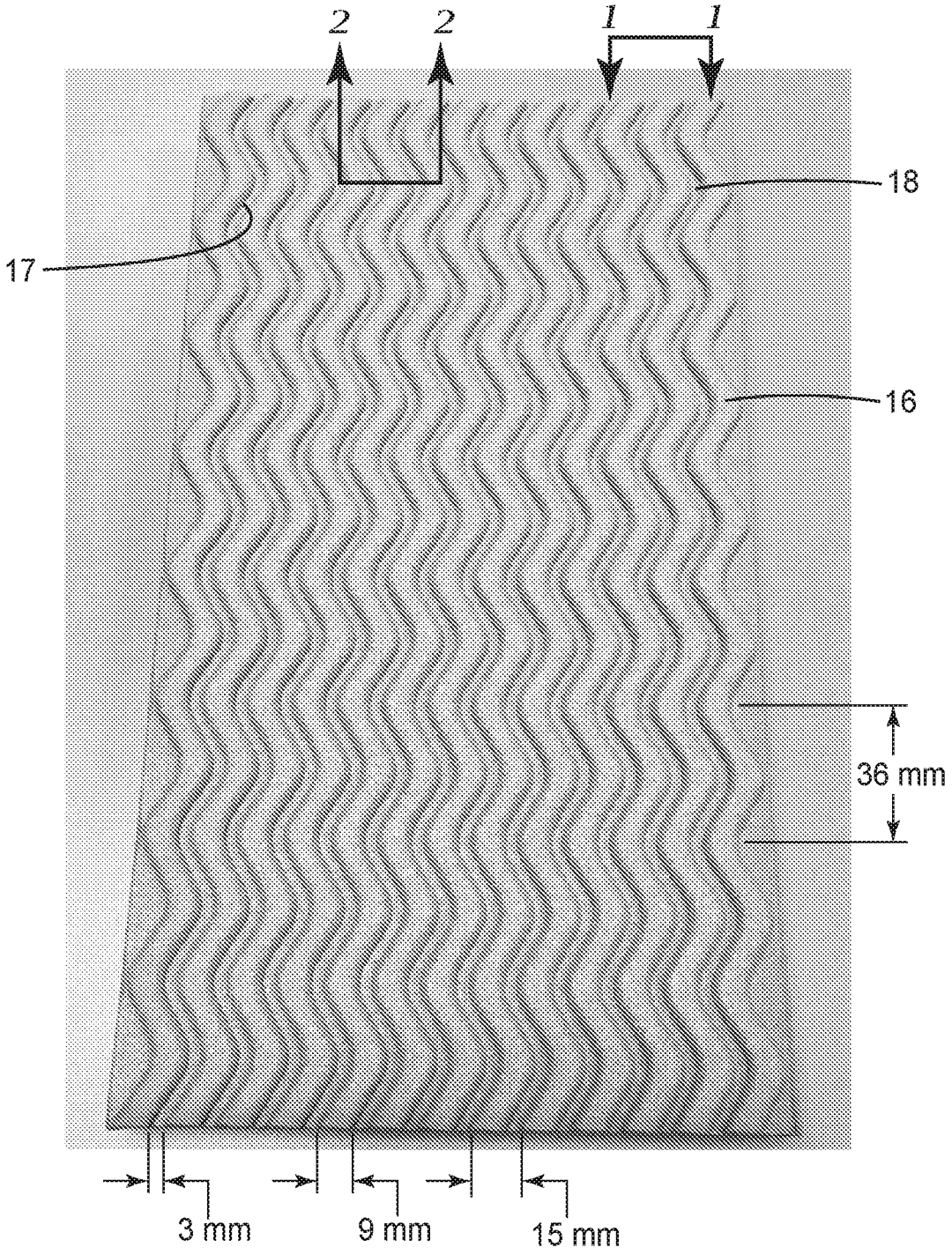
FIGS. 3-5 are each photographs of the working surfaces of illustrative embodiments of sanding blocks of the invention.
Figure 4:
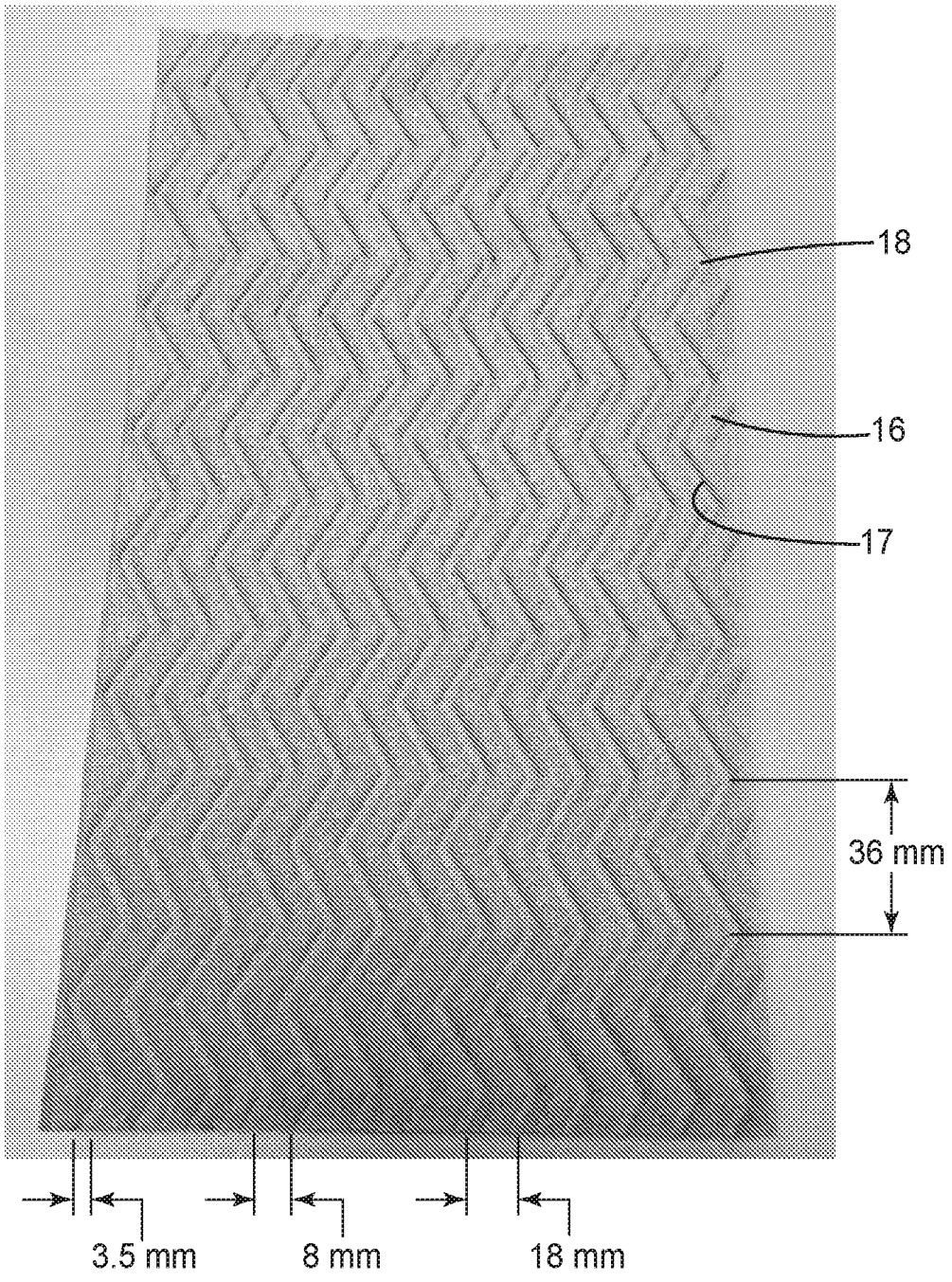
Figure 5:
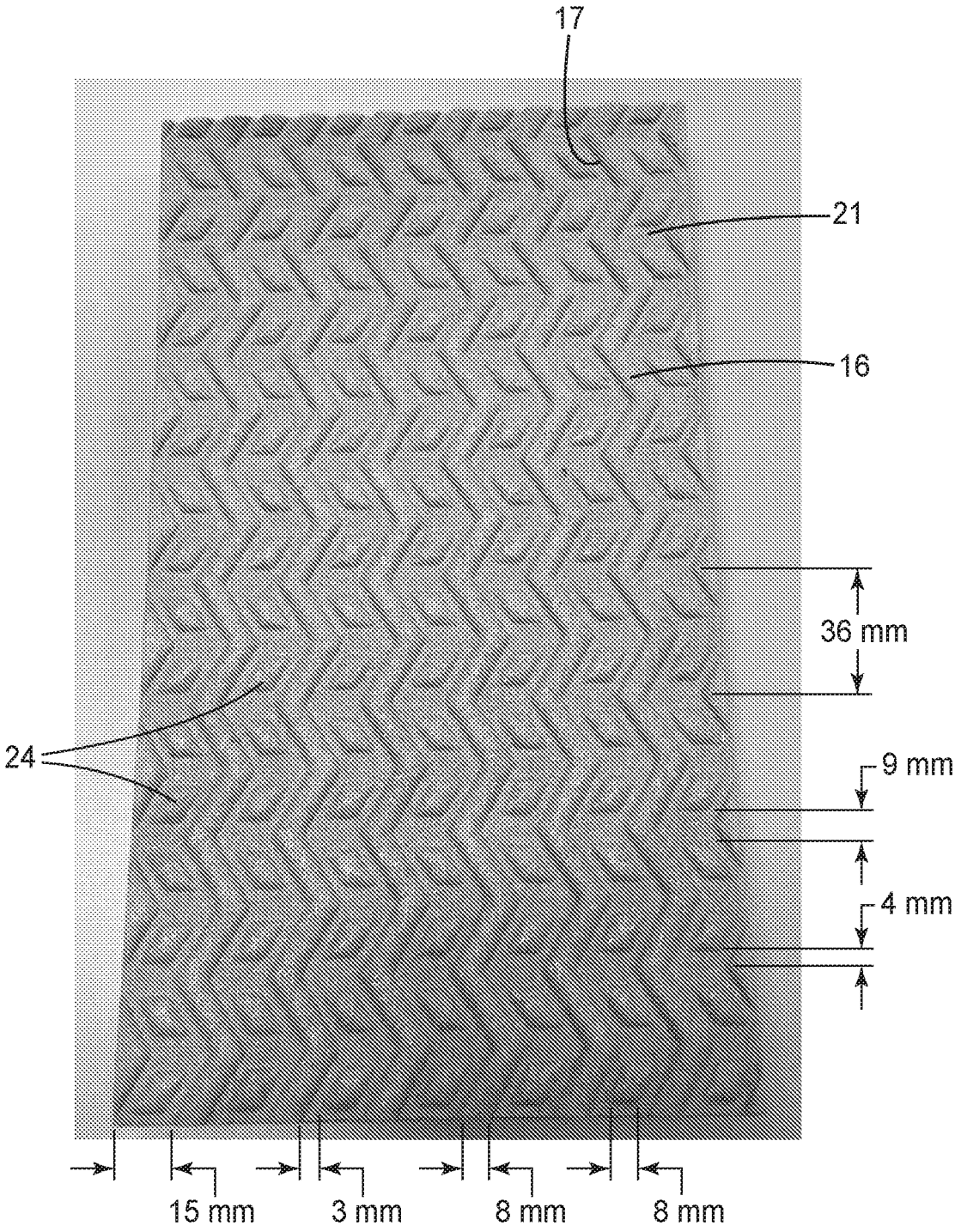

FIGS. 3-5 are each a photograph of the working surfaces of an illustrative embodiment of a sanding block of invention prior to application of a make coat with partially embedded abrasive particles therein. The sanding block shown in each of FIGS. 3-5 is substantially rectangular (i.e., the dimension of the sanding block in the x-axis is substantially constant as is the dimension of the sanding block in the y-axis). In each of these figures, the photograph is a perspective view taken somewhat offset from the z-axis as may be understood from the appearance in the photograph wherein the portion of the sanding block at the top of the image (which is relatively farther away due to the offset) appears narrower than the opposing end appearing at the bottom of the image (which is relatively closer due to the offset).

FIG. 3 shows an embodiment where the raised portions are an array of parallel sinusoidal-shaped elements (or crowns) 16 which define a corresponding array of parallel sinusoidal-shaped channels 18 or recessed portions. In this embodiment, the channels are about 3 mm wide in the x-axis, the raised portions are about 9 mm wide in the x-axis, corresponding side walls of adjacent channels are about 15 mm apart in the x-axis, and each sinusoid is about 36 mm long in the y-axis.

FIG. 4 shows an embodiment where the raised portions are an array of parallel chevron-shaped raised portions or crowns 16 which define a corresponding array of chevron-shaped channels 18 or recessed portions. In this embodiment, the channels are about 3.5 mm wide in the x-axis, the raised portions are about 8 mm wide in the x-axis, corresponding side walls of adjacent channels are about 18 mm apart in the x-axis, and each chevron unit is about 36 mm long in the y-axis.

FIG. 5 shows an embodiment with an array of chevron-shaped raised portions (i.e., "full crowns") separated by channels 18 in which the floor walls 21 of the channels have post-like raised portions (i.e., "island crowns") 24. Such configurations can be easily achieved by forming a molding tool with a nested array of chevron elements (e.g., such as the embodiment shown in FIG. 4), and removing portions of every other chevron element such that the molding tool imparts the surface shown in FIG. 5. In this embodiment, the channels are about 15 mm wide in the x-axis between sequential full crowns, the raised portions of the full crowns and island crowns are each about 8 mm wide in the x-axis, each chevron unit of the full crowns is about 36 mm long in the y-axis, adjacent island crowns are about 9 mm apart in the y-axis, and each island crown is about 3 mm apart from the adjacent full crown in the x-axis.

In accordance with the invention, the recessed portions or channels defined by the raised portions do not have a straight line dimension of longer than about 500 mm, typically from about 15 to about 50 mm. That is, within the plane defined by the x-axis and y-axis, no channel extends more than that distance.

In typical embodiments, the channels have an average depth (i.e., taken in the z-axis direction) of at least about 2 mm, preferably from about 2 to about 4 mm, and in some illustrative embodiments from about 3 to about 3.5 mm. In FIG. 1, this dimension is the difference between bottom wall 21 defining the floor of channel 18 and the most distance portions of raised portions 16 make coat 20 and abrasive particles 22.

In typical embodiments, the recessed portions have an average narrow dimension (i.e., the distance, within the x-y plane, between opposing side walls 17) of at least about from about 2 to about 6 mm, preferably from about 2.5 to about 4 mm.

As will be understood by those skilled in the art, in typical embodiments, the make coat (with embedded abrasive particles) is provided as a cap located primarily on the raised end surfaces of the raised portions and extending slightly down the sides into the channel so as to achieve a more secure bond to the raised portion, thereby extending service life of the sanding block. It is typically preferred that the surface of the channels (other than in this perimeter to the raised end surface) be substantially free of make coat and abrasive particles.

The raised end surfaces of the raised end portions 16 are typically each relatively planar and, with make coat and abrasive particles, collectively define an abrasive working surface. Typically configuration and dimensions of the raised end portions are such that the raised end surfaces are arranged in substantially planar array across the face of the sanding block.

In typical embodiments, the raised portions have an average narrowest dimension (i.e., the width of the raised end surfaces) of at least 2 mm, preferably at least about 3 mm, in some embodiments from about 7 to about 9 mm.

In accordance with the invention, the raised portions and raised end surfaces are elongate, that is they are longer than they are wide. In some embodiments, the raised portions have a minimum length of from about 15 to about 35 mm. In some embodiments, at least one and preferably substantially all of the raised portions extends the full length of the working surface.

Body

In many embodiments, the body is a unitary article.

In embodiments where the sanding block is to be used manually, it is typically sized so as to be manually graspable in a user's hand. Illustrative embodiments will have a width of at least about 2 inches (50 mm) and a length of at least about 3 inches (76 mm).

In some embodiments, the body is preferably resilient.

In some embodiments, the body is formed from a foam having a density of at least about 48 kg/m$^3$ (3 pcf or lbs/ft$^3$), often preferably at least about 56 kg/m$^3$ (3.5 lbs/ft$^3$).

In general, any resilient or conformable material with at least one coatable surface may be used for the body of the sanding article. These materials include open-cell foam, closed-cell foam, and reticulated foam, each of which can further include a durable outer skin layer. Suitable foam materials can be made from synthetic polymer materials, such as, polyurethanes, foam rubbers, silicones, and polyolefins, and natural sponge materials. The thickness of the foam body is only limited by the desired end use of the abrasive article. Preferred bodies have a thickness in the range of about 5 mm to about 50 mm, although bodies having a greater thickness can also be used.

Make Coat

In general, any make coat adhesive material may be used to adhere the abrasive particles to the resilient body. The make coat is typically formed by applying a make coat precursor to the body. "Make coat precursor" refers to the coatable resinous adhesive material applied to the body of the abrasive article, thereby serving to secure abrasive particles to the body. "Make coat" refers to the layer of hardened resin over the body of the abrasive article formed by hardening the make coat precursor.

In certain embodiments, the thickness of the make coat adhesive is adjusted so that at least about 10%, 20%, or 30% but no greater than about 35%, 40% or 45% of the individual grain length protrudes above the cured make layer. Generally, larger grit minerals (smaller grit numbers) require use of relatively more make adhesive than smaller grit minerals (larger grit numbers).

The make coat precursor is generally applied to the body of the article at a coating weight which, when cured, provides the necessary adhesion to securely bond the abrasive particles to the coatable surfaces of the body. For typical make coats, the dry add-on weight of the make coat will range from about 1 to about 20 grains/24 in$^2$ (4.2 to 84 g/m$^2$). In certain embodiments, the make coat dry add-on weight will have a lower limit of 2 grains/24 in$^2$ (8.4 g/m$^2$), 4 grains/24 in$^2$ (16.8 g/m$^2$), or 6 grains/24 in$^2$ (25.2 g/m2), and will have an upper limit of 8 grains/24 in$^2$ (33.6 g/m$^2$), 10 grains/24 in$^2$ (42 g/m$^2$), or 12 grains/24 in$^2$ (50.4 g/m$^2$).

The make coat layer preferably comprises organic precursor polymer subunits. The precursor polymer subunits preferably are capable of flowing sufficiently so as to be able to coat a surface. Solidification of the precursor polymer subunits may be achieved by curing (e.g., polymerization, crosslinking, etc.), by drying (e.g., driving off a liquid), or simply by cooling depending upon the nature of the material. The precursor polymer subunits may be an organic solvent borne, a water-borne, or a 100% solids (i.e., a substantially solvent-free) composition. Both thermoplastic and thermosetting materials, as well as combinations thereof, may be used as precursor polymer subunits. Upon the curing, drying or cooling of the precursor polymer subunits, the composition forms the make coat. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, rubber resins, or mixtures thereof.

The precursor polymer subunits are preferably a curable organic material (i.e., a polymer subunit or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, polyol modified epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.).

Preferred cured abrasive coatings are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof. The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2-(2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinyl-piperidone.

A preferred precursor polymer subunit contains a blend of two or more acrylate monomers. For example, the precursor polymer subunits may be a blend of trifunctional acrylate and a monofunctional acrylate monomers. An example of one precursor polymer subunits is a blend of propoxylated trimethylol propane triacrylate and 2-(2-ethoxyethoxy) ethyl acrylate.

It is also feasible to formulate a precursor polymer subunits from a mixture of an acrylate and an epoxy polymer (e.g., as described in U.S. Pat. No. 4,751,138 (Tumey et al.)).

Other precursor polymer subunits include isocyanurate derivatives having at least one pendant acrylate group and isocyanate derivatives having at least one pendant acrylate group are further described in U.S. Pat. No. 4,652,274 (Boettcher et al.). The preferred isocyanurate material is a triacrylate of tris(hydroxyethyl) isocyanurate.

Still other precursor polymer subunits include diacrylate urethane esters as well as polyacrylate or poly methacrylate urethane esters of hydroxy terminated isocyanate extended polyesters or polyethers. Examples of commercially available acrylated urethanes include those under the trade name "UVITHANE 782," available from Morton Chemical, Moss Point, Miss.; "CMD 6600," "CMD 8400," and "CMD 8805," available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or polymethacrylate epoxy ester such as the diacrylate esters of bisphenol-A epoxy polymer. Examples of commercially available acrylated epoxies include those under the trade name "CMD 3500," "CMD 3600," and "CMD 3700" from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The precursor polymer subunits may also be an acrylate dispersion like that described in U.S. Pat. No. 5,378,252 (Follensbee).

In some cases, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.).

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of suitable commercially available, ultraviolet-activated photoinitiators have trade names such as "IRGACURE 651," "IRGACURE 184," and "DAROCUR 1173" commercially available from Ciba Specialty Chemicals, Tarrytown, N.Y. Another visible light-activated photoinitiator has the trade name "IRGACURE 369" commercially available from Ciba Geigy Company. Examples of suitable visible light-activated initiators are reported in U.S. Pat. No. 4,735,632 (Oxman et al.) and U.S. Pat. No. 5,674,122 (Krech et al.).

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX," "QUANTICURE QTX," "QUANTICURE PTX," "QUANTICURE EPD" from Biddle Sawyer Corp.

In general, the amount of photosensitizer or photoinitiator system may vary from about 0.01 to about 10% by weight, more preferably from about 0.25 to about 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, available from BASF Corporation, Ludwigshafen, Germany, under the trade designation "LUCIRIN TPO-L." Other examples of acylphosphine oxides include "DAROCUR 4263" and "DAROCUR 4265" from Ciba Specialty Chemicals.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340 (Palazzotto), and U.S. Pat. No. 4,950,696.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

The make coat is applied to at least one side of the article and may be applied to any number of surfaces. The make coat binder precursor can be coated by any conventional technique, such as knife coating, spray coating, roll coating, rotogravure coating, curtain coating, and the like. The abrasive coating is typically applied to the surfaces coated with make coat. If applied to two surfaces, the abrasive particle size may be the same for each side or may be different for each side.

Abrasive Particles

Abrasive particles are embedded in the make coat. In accordance with one aspect of the invention, the abrasive particles are selected to allow the sanding block to be used to sand, abrade, or otherwise remove material from a work surface, in particular drywall joints. That is, the abrasive particles are sufficiently hard to remove material from the surface itself, not just remove foreign material that is adhered to the surface being sanded. Stated another way, the abrasive particles are selected to scratch or "damage" the surface. This is in contrast to, for example, kitchen or bath cleaning, scrubbing, or polishing operations in which damage or scratching of the surface is undesirable and is to be avoided.

Suitable abrasive particles typically have a hardness of at least about 1200 Knoops, more typically at least about 2000 Knoops, and even more typically at least about 2400 Knoops. Specific abrasive particles suitable for the abrasive article of the invention are described separately below.

In some embodiments for sanding drywall joints, the abrasive particles will be selected and applied to provide an abrasive working surface having about 100 to about 150 grit.

Abrasive particles suitable for this invention include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. Examples of sol gel abrasive particles can be found in U.S. Pat. No. 4,314,827 (Leitheiser, et al.); U.S. Pat. No. 4,623,364 (Cottringer et al); U.S. Pat. No. 4,744,802 (Schwabel); U.S. Pat. No. 4,770,671 (Monroe et al.); U.S. Pat. No. 4,881,951 (Wood, et al.). The abrasive particles can be either shaped (e.g., rod, triangle, or pyramid) or unshaped (i.e., irregular). The term "abrasive particle" encompasses abrasive grains, agglomerates, or multi-grain abrasive granules. Examples of such agglomerates are described in U.S. Pat. No. 4,652,275 (Bloecher, et al.) and U.S. Pat. No. 5,975,988 (Christianson). The agglomerates can be irregularly shaped or have a precise shape associated with them, for example, a cube, pyramid, truncated pyramid, or a sphere. An agglomerate comprises abrasive particles or grains and a bonding agent. The bonding agent can be organic or inorganic. Examples of organic binders include phenolic resins, urea-formaldehyde resins, and epoxy resins. Examples of inorganic binders include metals (such as nickel), and metal oxides. Metal oxides are usually classified as either a glass (vitrified), ceramic (crystalline), or glass-ceramic. Further information on ceramic agglomerates is disclosed in U.S. Pat. No. 5,975,988 (Christianson).

Useful aluminum oxide grains for applications of the present invention include fused aluminum oxides, heat treated aluminum oxides, and ceramic aluminum oxides. Examples of such ceramic aluminum oxides are disclosed in U.S. Pat. No. 4,314,827 (Leitheiser, et al.), U.S. Pat. No. 4,744,802 (Schwabel), U.S. Pat. No. 4,770,671 (Monroe, et al.), and U.S. Pat. No. 4,881,951 (Wood, et al.).

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,951 (Celikkaya et al.); U.S. Pat. No. 5,085,671 (Martin et al.) and U.S. Pat. No. 5,042,991 (Kunz et al.).

The average particle size of the abrasive particle for advantageous applications of the present invention is at least about 0.1 micrometer, preferably at least about 65 micrometers. A particle size of about 100 micrometers corresponds about to a coated abrasive grade 150 abrasive grain, according to American National Standards Institute (ANSI) Standard B74.18-1984. The abrasive grain can be oriented, or it can be applied to the surface of the abrasive article without orientation, depending upon the desired end use of the abrasive article.

The abrasive particles can be embedded into the make coat precursor by any conventional technique such as electrostatic coating or drop coating. During electrostatic coating, electrostatic charges are applied to the abrasive particles and this propels the abrasive particles upward. Electrostatic coating tends to orient the abrasive particle, which generally leads to better abrading performance. In drop coating, the abrasive particles are forced from a feed station and fall into the binder precursor by gravity. It is also within the scope of this invention to propel the abrasive particles upward by a mechanical force into the binder precursor.

Additives

The make coat precursor or the size coat precursor or both can contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. Fillers can be used in amounts up to about 400 parts, preferably from about 30 to about 150 parts, per 100 parts of the make or size coat precursor, while retaining good flexibility and toughness of the cured coat. The amounts of these materials are selected to provide the properties desired, as known to those skilled in the art.

Organic solvent, water, or other suitable fluids may be added to the precursor compositions to alter viscosity. The selection of the particular fluid is believed to be within the skill of those practicing in the field and depends upon the thermosetting resin utilized in the binder precursor and the amounts of these resins utilized.

General Method of Making

The make coat of the various embodiments described herein may be applied using conventional coating techniques including, for example, roll coating, spray coating, or curtain coating. Surprisingly, it has been found that when the viscoelastic properties of the make coat composition and the rate of applying the make coat are carefully controlled, the make coat can be applied to the end surfaces of the separated regions without also applying the make coat to the regions between the separated portions using curtain coating.

The abrasive particles may be applied to the make coat using conventional techniques such as drop coating or electrostatic coating.

The structured topography of the active portion of the various embodiments of the invention described herein may be formed using a variety of techniques including cutting the resilient body using, for example, a blade, laser, water jet, or heated wire either before or after the make coat and abrasive particles have been applied to the resilient body. In addition, the surface topography may be formed using a heat molding die having the desired pattern.

General Method of Use

Sanding blocks of the invention are particularly well suited for use in sanding drywall joints, patches, and surfaces. Briefly summarizing, the method of the invention comprises:

(a) providing a sanding block as described herein;

(b) grasping the sanding block by hand such that the working surface is presented to engage with a drywall joint or patch;

(c) contacting the working surface to the drywall joint or patch; and (d) repeatedly moving the sanding block in an abrasive manner against the drywall joint or patch so as to smooth the drywall joint or patch.

In use, sanding blocks of the invention may be gripped by one hand, or if desired two hands.

To achieve desired abrasion, the block is typically moved in a circular or other looping sweep motion, sometimes dictated by the configuration of the work area and access thereto.

In typical embodiments, sanding blocks of the invention are used in predominately reciprocal (i.e., back-and-forth) motion with the sanding block oriented such that the general axis of the raised portions (i.e., the plane defined by the x-axis and y-axis) is parallel or moderately offset to the direction of reciprocating action, for instance typically within about 30°, often within about 20°, or less. Such orientations enable comfortable sanding action, wider, faster range of work, and tend to yield smoother surface results. If the offset is greater, the potential range of motion is reduced (thereby reducing effectiveness of the sanding work) and increasing the potential for causing gouges and depressions in the surface.

As will be understood, sanding blocks of the invention and the method of the invention can be efficaciously used on flat drywall joints and patches, as well as curved locations (e.g., bullnose corners).

It has been surprisingly discovered that the sanding blocks provided herein provide effective and efficient sanding of drywall with a dramatic reduction in dust generation and dust dispersion. To a surprising degree, dust generated by sanding is captured within the channels or falls more predominately down from the locus of the sanding operation than is the case with conventional sanding media which disperse the dust more generally about the working area, making the working environment dustier and dirtier as well as requiring greater cleanup effort.

Various modifications and alterations to this invention will become apparent to those skilled in the art without departing from the scope and spirit of this invention. For example, it will be recognized that two or more surface of the resilient body may include structured abrasive surfaces and that the abrasive surfaces may include different types and sizes of abrasive particles. It should be understood that the invention is not intended to be unduly limited by the illustrative embodiments set forth herein and that such embodiments are presented by way of example only with the scope of the invention intended to be limited only by the claims set forth herein as follows.

EXAMPLES

The invention may be further understood with reference to the following illustrative examples.

Unless otherwise noted, all parts, percentages, ratios, etc. in the examples and the rest of the specification are by weight percent, and all reagents used in the examples were obtained, or are available, from general chemical suppliers such as, for example, Sigma-Aldrich Company, Saint Louis, Mo., or may be synthesized by conventional methods.

Materials

HYCAR® 2679 is an acrylic latex containing about 50 weight % solids acrylic polymer in an aqueous medium from Lubrizol, Brecksville, Ohio.

CARBOPOL® EZ-3 is an acrylic resin powder comprised of crosslinked acrylic acid polymer used as a thickener from Lubrizol, Brecksville, Ohio.

EZ-3 Solution is a 2.5 weight % aqueous solution of CARBOPOL® EZ-3.

SILWET® L-77 is a polyalkyleneoxide modified heptamethyltrisiloxane surfactant from Momentive Performance Materials, Albany, N.Y.

PHENOLIC BB-077 is a 70 weight % aqueous solution of a phenolic resin from Arclin Mississauga, Mississauga, Ontario, Canada.

Foam Substrate

The substrate used to prepare each of the sanding articles was an MDI based polyether polyurethane open cell foam from Rempac, Lumberton, N.C., or 3M Company, St. Paul, Minn. The foam had the following properties: Density of about 60 kg/m$^3$ (3.75 lbs/ft$^3$)+/−10% (according to ASTM D 3574-95—Test A); Ultimate Elongation of at least about 75% (according to ASTM D 3574-95—Test E); Tensile Strength of at least about 380 kPa (55 PSI) (according to ASTM D 3574-95—Test E); Tear Strength of at least about 3.0 lbs/in (according to ASTM D 3574-95—Test F). The foam sheet was about 1.125 inches thick and was either about 2 feet wide by about 4 feet long, or about 5 feet wide by about 7 feet long. The foam sheets were embossed with the patterns shown in FIGS. 3-5. A platen having the negative image of the desired pattern for the working surface of the sanding article was placed on the foam sheet. The platen was heated to about 125° C. to about 175° C. and held under pressure (e.g., about 2.5 to about 6.5 kg/per ft$^2$) for 3 to 5 minutes.

Make Coat Adhesive

The make coat adhesive was a water borne acrylic having the formulation provided in Table 1. The components were added with mixing in the order provided in the Table.

TABLE 1

| Component | Amount (weight %) |
|---|---|
| HYCAR 2679 | 90.58 |
| EZ-3 Solution | 4.80 |
| Water | 1.30 |
| SILWET L-77 | 0.45 |
| Green Pigment | 1.95 |
| White Pigment | 0.79 |
| Ammonium Hydroxide | 0.17 |

Size Coat

The size coat was a water borne phenolic having the formulation in Table 2. The components were added with mixing in the order provided in the Table 2.

TABLE 2

| Component | Amount (weight %) |
|---|---|
| Phenolic BB-077 | 57.14 |
| SILWET ® L-77 | 0.10 |
| Glycerol | 1.00 |
| Water | 41.76 |

Test Method—Determination of Dust Channeling

1. Skim coat 1 foot×2 foot (30 cm by 61 cm) drywall panels with normal drywall joint compound and allow to dry for 24 hours. (joint compound used was USG SHEETROCK® PLUS 3®, USG Corporation, Chicago, Ill.)
2. Using a SHARPIE® pen, mark the drywall panel with the stroke length (18 inches) to be used when sanding with the sanding article.
3. Weigh to the nearest 0.1 gram a large 13 in×9 in (33 cm by 23) cake pan and the drywall panel to be sanded.
4. Place the drywall panel in vertical orientation into the cake pan and rest the back of the drywall sheet against a pillar or other immoveable object to support it at an angle slightly less than 90 degrees.
5. With the crown portions oriented for the dust to fall in the pan (i.e., the y-axis of the sanding block as shown in FIGS. 1-3, respectively, oriented down toward the pan), sand the panel 20 strokes back and forth moving between the marks on the panel. Do not over sand down to the drywall paper.
6. Tap the sponge on the panel to remove built up dust, weigh the dust collected and the panel and the weight loss of the panel.
7. Calculate the difference between the weight loss of the panel and dust collected. This difference is the airborne fraction of dust produced.

Examples 1-3

In a typical procedure for preparing the sanding articles of the present invention, the make coat adhesive was roll coated onto the foam sheet so that the adhesive was applied to the raised end surfaces of the raised portions of the sheet (i.e., substantially not in the recessed portions). Enough pressure was applied to allow the adhesive to coat about 0.1 mm down the sides of the vertical surfaces of the raised portions (i.e., side walls of the channels). This helps to impart enough integrity to the abrasive components of the raised portions so that they do not become easily abraded off when sanding. The abrasive mineral (DURALUM® Special White aluminum oxide from Washington Mills Electro Minerals, Niagara, N.Y.) was then applied to the make coat adhesive coating. The coated sheet was then dried in an oven maintained at about 315° F. (157° C.). The size coat was then roll coated over the abrasive mineral and the coated sheet was dried in an oven maintained at about 325° F. (165° C.). The coated sheet was then turned over and sent through the line for additional coating so that the foam sheet had the abrasive coating on all sides of the foam (excluding the ends). The make coat adhesive dry coating weight was targeted to be 12 grains/24 $in^2$ (50.4 $g/m^2$). The coating weight of the abrasive mineral was targeted to be 80 grains/24 $in^2$ (336 $g/m^2$). The size coat dry coating weight was targeted to be 1.6 grains/24 $in^2$ (6.7 $g/m^2$). The coated abrasive foam sheets were then cut into 6.3 cm by 11.4 cm (2.5 inch wide by 4.5 inch) long sample sanding blocks to be used for testing. Examples 1, 2, and 3 were made having the patterns shown in FIGS. 5, 3, and 4 respectively Comparative Example CE-1

A sanding black having a straight, linear groove pattern was also prepared using the procedure described above. The foam sheet used for this sanding article, referred to here as Comparative Example CE-1, had parallel, linear channels that were about 3 mm deep and 4 mm wide and the raised end surfaces that were about 6 to about 7 mm wide.

Comparative Examples CE-2

The fine side only a commercially available sanding sponge (3M® Large Drywall Sanding Sponge Fine/Medium Cat No. 9095NA from 3M Company, St. Paul, Minn.) was also tested as Comparative Example CE-2. Unlike Examples 1-3 and Comparative Example CE-2, this sanding block did not have any channels The performance of the sanding blocks were as Results are provided in Table 3.

TABLE 3

| Example | Material Removed (g) | Captured on Block (g) | Airborne (g) | % Airborne | % Captured | % Airborne Reduction from CE-2 |
|---|---|---|---|---|---|---|
| 1 (FIG. 5) | 11 | 8.5 | 1.5 | 23 | 77 | 58 |
| 2 (FIG. 3) | 10 | 8.5 | 1.5 | 15 | 85 | 66 |
| 3 (FIG. 4) | 11 | 7.5 | 3.5 | 31 | 69 | 50 |
| CE-1 (Straight line channels) | 10 | 3.5 | 6.5 | 65 | 35 | 16 |
| CE-2 (Flat surface) | 11 | 2 | 9 | 81 | 19 | — |

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom. The complete disclosure of all patents, patent documents, and publications cited herein are incorporated by reference.

What is claimed is:

1. A sanding block adapted for abrading a drywall joint, the block comprising:

(a) a body including a bottom edge, a top edge, and two side edges, the body having an array of a plurality of elongated raised portions having raised end surfaces and a plurality of recessed portions, the raised end surfaces collectively defining an abrasive working surface and the recessed portions defining channels between adjacent raised portions; wherein the channels open on two of the edges, and wherein the channels extend between the channel openings along a continuous, non-linear path between the top and bottom edges, such that the channels have an average longest straight line dimension of from about 15 to about 50 mm;

(b) a make coat on at least a portion of the end surfaces; and (c) abrasive particles at least partially embedded in the make coat;

wherein the recessed portions have an average depth of at least about 2 mm and have an average narrow dimension of at least about 2 mm; and wherein the raised portions have a minimum straight line dimension of at least about 15 mm.

2. The sanding block of claim 1 wherein the recessed portions have an average depth of at from about 2 to about 4 mm.

3. The sanding block of claim 1 wherein the recessed portions have an average depth of from about 3 to about 3.5 mm.

4. The sanding block of claim 1 wherein the recessed portions have an average narrow dimension of from about 2 to about 6 mm.

5. The sanding block of claim 1 wherein the raised portions are an array of parallel chevron-shaped or sinusoidal-shaped portions.

6. The sanding block of claim 1 wherein the raised portions have an average narrowest dimension of at least about 2 mm.

7. The sanding block of claim 1 wherein the raised portions have an average narrowest dimension of from about 7 to about 9 mm.

8. The sanding block of claim 1 wherein the raised portions have a minimum length of from about 15 to about 35 mm.

9. The sanding block of claim 1 where at least one raised portions extends the full length of the working surface.

10. The sanding block of claim 1 wherein the abrasive particles have a hardness of at least 1200 Knoops.

11. The sanding block of claim 1 wherein the abrasive particles have a hardness of at least 2,000 Knoops.

12. The sanding block of claim 1 wherein the abrasive particles are selected from the group consisting of aluminum oxide, alumina-based ceramics, silicon carbide, zirconia, alumina-zirconia, garnet, diamond, ceria, cubic boron nitride, ground glass, quartz, titanium diboride, sol gel abrasives, and combinations thereof.

13. The sanding block of claim 1 wherein the body is a unitary article.

14. The sanding block of claim 1 wherein the sanding block article has a width of at least 2 inches (50 mm) and a length of at least 3 inches (76 mm).

15. The sanding block of claim 1 wherein the body is resilient.

16. The sanding block of claim 15 wherein the body is formed of foam having a density of at least 3 pcf.

17. The sanding block of claim 15 wherein the body is formed of an open cell foam or a closed cell foam.

18. A method of sanding a drywall joint or drywall patch comprising:

(a) providing a sanding block of claim 1;

(b) grasping the sanding block by hand such that the working surface is presented to engage with a drywall joint or patch;

(c) contacting the working surface to the drywall joint or patch; and (d) repeatedly moving the sanding block in an abrasive manner against the drywall joint or patch so as to smooth the drywall joint or patch.

19. The method of claim 18 wherein the sanding block is grasped by two hands.

20. The method of claim 18 wherein the sanding block is repeatedly moved in a reciprocating manner against the drywall joint or patch.

* * * * *